United States Patent [19]

Zimmer

[11] Patent Number: 4,993,352

[45] Date of Patent: Feb. 19, 1991

[54] SQUEEGEE DEVICE

[76] Inventor: Johannes Zimmer, Ebentaler Strasse 133, 9020 Klagenfurt, Austria

[21] Appl. No.: 381,680

[22] PCT Filed: May 18, 1988

[86] PCT No.: PCT/EP88/00431

§ 371 Date: Jul. 13, 1989

§ 102(e) Date: Jul. 13, 1989

[87] PCT Pub. No.: WO89/03256

PCT Pub. Date: Apr. 20, 1989

[30] Foreign Application Priority Data

| | | | |
|---|---|---|---|
| Oct. 10, 1987 | [EP] | European Pat. Off. | 87730126.7 |
| Oct. 10, 1987 | [EP] | European Pat. Off. | 87730128.3 |
| Oct. 10, 1987 | [EP] | European Pat. Off. | 3734747.0 |
| Oct. 10, 1987 | [EP] | European Pat. Off. | 8713789.5 |
| Oct. 10, 1987 | [EP] | European Pat. Off. | 8713788.7 |

[51] Int. Cl.[5] ..... B05C 11/04; B41F 15/42

[52] U.S. Cl. ..... 118/112; 118/119; 118/126; 118/413; 118/414

[58] Field of Search ..... 118/110, 112, 113, 117, 118/118, 119, 123, 126, 413, 414

[56] References Cited

U.S. PATENT DOCUMENTS

| | | | |
|---|---|---|---|
| 3,128,207 | 4/1964 | Schmitt | 118/126 |
| 3,919,973 | 11/1975 | Zimmer | 118/406 |
| 4,094,241 | 6/1978 | Kossler | 118/414 |
| 4,216,716 | 8/1980 | Zimmer | 118/213 |
| 4,375,202 | 3/1983 | Miller | 118/122 |
| 4,416,215 | 11/1983 | Tachibana et al. | 118/414 |
| 4,637,338 | 1/1987 | Wohrle | 118/123 |
| 4,665,723 | 5/1987 | Zimmer | 118/406 |

FOREIGN PATENT DOCUMENTS 464967 12/1968 Switzerland .

*Primary Examiner*—Jay W. Woo
*Assistant Examiner*—Khanh P. Nguyen
*Attorney, Agent, or Firm*—Fay, Sharpe, Beall, Fagan, Minnich & McKee

[57] ABSTRACT

A squeegee device is used for applying materials of varying viscosities, such as coating substances, varnishes and adhesives to an application surface. The squeegee is pressed onto the application surface by a magnetic force. A profile member houses the squeegee and is pivotably supported by a bearing. The bearing allows the squeegee and profile member to be tiltable along an axis that is perpendicular to the longitudinal axis of the squeegee or profile member in order to insure a tilting-free and bending-free adjustment of the squeegee on the application surface.

21 Claims, 2 Drawing Sheets

Fig. 6
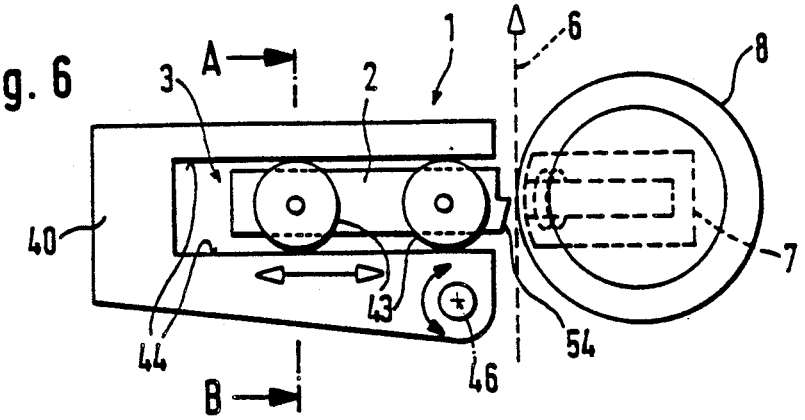
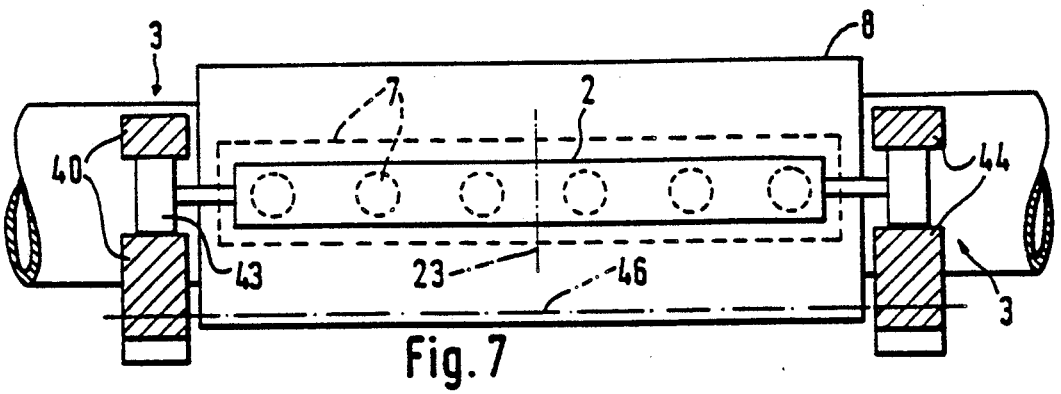
Fig. 7
Fig. 8
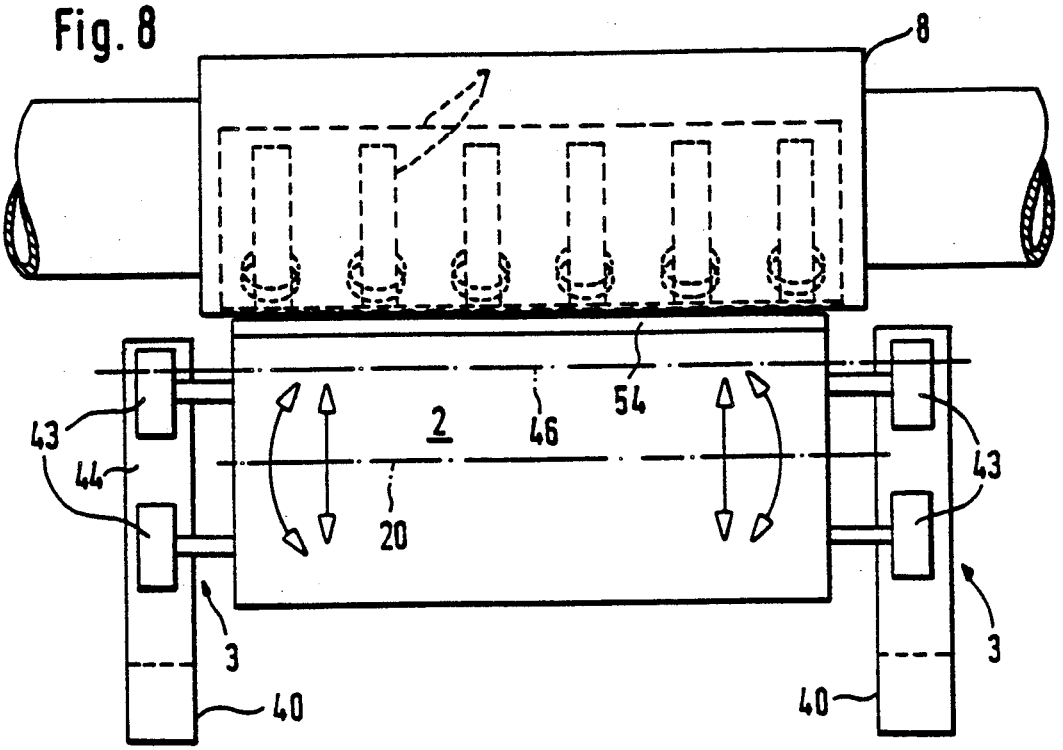

SQUEEGEE DEVICE

The invention relates to a squeegee device for applying materials such as an optionally foamable substances of different viscosity, coating substances, varnishes, adhesives, pastes, etc. to an application surface (substrate) with at least one squeegee extending in the longitudinal direction of the squeegee device and which is pressable by magnetic force. The squeegee device comprises a profile member extending with its longitudinal axis in the direction of the longitudinal axis of the squeegee and a bearing for articulating the profile member. The squeegee and/or profile member are made at least partly from magnetically acting parts. Such a squeegee device, in which the squeegee is constructed optionally with a nozzle integrated therein, is used in machines for flat stencil printing, round stencil applications and/or means for stencil-less, full-surface applications with respect to the application width, the squeegee extension being in particular several meters. As a function of the machine type, it is possible to carry out patterning applications (printing) and/or full-surface applications (e.g. impregnation, coating, dyeing and varnishing).

A squeegee and/or a squeegee device incorporating the same has great significance in connection with the handling of an applying device and in connection with the substance application result. It is known to provide on the back of a pivotably held sheet spreading doctor a magnetizable strip firmly connected to the latter over the application width. By means of the same, the doctor can be magnetically pressed by the magnetic force of a magnetic beam or bar arranged below the application surface in the direction of the latter (DE-OS 34 19 590). A squeegee device is also known (DE-OS 25 44 784), in which a squeegee roller is magnetically pressable against the back of a separately arranged profile strip spaced from the rolling surface of the squeegee roller. In addition, devices are known which have mechanically pressable squeegees, which are laterally fixed and pressed in the direction of the application surface. In all cases the squeegee or a strip or ledge engaging thereon are fixed between two bearings in the vicinity of the longitudinal side ends of said components. It is necessary to ensure with such bearing means longitudinal side coinciding bearing adjustments and optionally an identical mechanical force introduction. Such complicated bearing and/or pressing means, due to the unavoidable operational and fixing forces, lead to distortions and possibly permanent bending and therefore to damage and uncontrolled transverse positioning and/or mispositioning of the squeegee, so that the quality of the application result on starting an applying device and also during operation is considerably impaired and even made completely unusable due to sudden irregularities along the application surface. It must also be borne in mind that particularly with large application widths even minimum doctor distortions can have very disadvantageous effects on the printing result. Thus, optionally a time-consuming, costly readjustment of the squeegee device and/or even replacement of damaged doctors is necessary.

In view thereof, it is the object of the present invention to provide a squeegee device comprising at least one magnetically pressable squeegee, with a bearing means, which ensures a tilting-free, bending-free, as well as printing-precise self-adjustment and orientation of the squeegee on an application surface.

In conjunction with the features of the initially mentioned squeegee device, this task is solved in that the bearing means is constructed as a pivot bearing means arranged on the profile member forming or guiding the squeegee and with which the profile member is freely tiltable with respect to a position parallel to the application surface about at least one pivot axis perpendicular to its longitudinal axis. The inventive squeegee profile member with free pivot bearing means about at least one axis perpendicular to the profile member longitudinal axis ensures a distortion-free and tilting-free, self-setting orientation of the squeegee over the length of the device (application width). During the switching on of the magnetic pressing means and/or when the device is in operation, the squeegee is freely positioned and held, i.e. without the conventional bearing-caused reactive forces. During application operation, it adapts to possibly occurring inclination irregularities in the position of the application surface (substrate). Thus, in connection with the magnetic pressing, there is an optimization both for the start of application and during application. Disadvantageous bending actions and/or readjustments of the bearings, which frequently have to be carried out in application means with conventional magnetically pressable squeegee devices are obviated. The life of the profile member and/or squeegee is considerably increased, because damage thereto by bearing-caused fixing and/or distortion effects is eliminated. There is also no need for a reworking or realignment of the distorted doctors and/or profiled bodies optionally necessary with conventional squeegee devices.

In order to vary a substance space, a substance dynamic pressure and/or the contact pressure, a variability of the angle of inclination of a squeegee or spreading edge and/or the profile member with respect to the application surface is very important. A very simple and planned influencing of these parameters, particularly during continuous application operation, is achieved by a further development of the invention in that the pivot bearing means comprises a multiple pivot bearing, with which the profile member is also freely pivotable about at least one axis parallel to its longitudinal axis. According to a special design the pivot bearing means comprises a multiple pivot bearing with which the profile member is freely pivotable about all directions in space. This ensures a free adjustment and orientation of the squeegee along all the working positions.

According to an embodiment of the invention the pivot bearing means is constructed in the form of a ball or spherical joint or a ring joint having rings hung in one another. This bearing provides, in a constructionally particularly simple manner, the free pivoting articulation of the profile member forming or guiding the squeegee.

According to another embodiment of the invention, it can also be appropriate for the pivot bearing means to comprise link brackets or bearings arranged in the vicinity of the longitudinal side ends of the profile member, the latter being held with arms, which are in each case movably held in the lateral link bracket or bearing in directions transverse to and along the longitudinal axis of the profile member. In this embodiment the arms are held advantageously in such a way that they are pivotable in the particular link bearing about an axis parallel to the longitudinal axis of the profile member, so that the effective doctor (squeegee) surface and/or the magnetically active mass of the squeegee can be freely adjusted by varying the inclination position of these components with respect to the application surface. A special construction of the link pivot bearing means comprises each arm being held pivotably about its extension axis.

In order to control the angle of inclination of the squeegee (the profile member) with respect to a fixed abutment for the application surface, the pivot bearing means is arranged on a guide bearing means, with which the pivot bearing means is movable in at least one direction perpendicular to the longitudinal axis of the profile member. As a result of the pivot bearing means having several degrees of freedom there is an automatic compensation of any bearing irregularities of the guide bearing means. This can be relatively simply realized, because excessively high demands are not made on the accuracy thereof.

The invention makes it possible in a simple manner to automatically position and hold the profile member (squeegee) over the longitudinal extension thereof in a fixed (small) equidistant spacing with respect to an abutment for the application surface. This contactless positioning with respect to a material web (application surface) is very important for certain application types. For this purpose the invention provides for the pivot point or points of the pivot bearing means to be arranged in a plane vertically intersecting the longitudinal axis of the profile member and in which is located the pivot point of the profile member. The pivot bearing means is kept at a specific distance from a counterabutment for the substrate and pivotability about an axis parallel to the profile member longitudinal axis is avoided or limited in the direction towards the counterabutment. Beyond this, the articulation in or in the vicinity of the centre of gravity plane is generally advantageous in all embodiments of the invention, because in this way an easy self-adjustment with magnetic contact pressure can be achieved.

According to a particularly appropriate and advantageous development of the invention, the profile member is constructed as a support body bringing about the pressing of the squeegee against the application surface and having a receptacle or recess parallel to its longitudinal axis and in which the squeegee is mounted in the form of a roller doctor. The profile member is also tiltable about the longitudinal axis of the roller doctor, the receptacle web range engaging thereon along different vertex lines of the doctor. The roller doctor is guided and aligned with the receptacle in the profile member.

Varied doctor (squeegee) profiles can be formed on the profile member. It can in particular have a sheet spreading doctor in the form of a blade, a profiled strip with a round or wedge-shaped working edge and also a profiled surface provided in addition to a doctor. The profiled surface is formed in the doctor direction upstream of a doctor in the vicinity of the substance to be applied, so that it forms a wedge-shaped space for the same with respect to a stencil or a material web and its size permits a control of the prior doctor or squeegee treatment and/or a dosing for the application. For such a construction the profile member is articulated in a freely pivotable manner about an axis parallel to its longitudinal axis.

The free self-adjustment and orientation of the profile member (squeegee) according to the invention which can be brought about under magnetic force is particularly suitable for a squeegee device, in which the profile member comprises a magnetic device arranged along its longitudinal axis, such as a permanent or electric magnet or an arrangement in rows of such components. Such a squeegee device can work against a magnetizable substrate abutment, e.g. in the form of a steel table or roller, without it being necessary to arrange a magnetic bar on the counterabutment.

Further advantages, developments and embodiments of the invention can be gathered from the following description relative to the drawings, wherein FIGS. 1 and 2 show in partial cross-section, a squeegee device according to the invention;

FIG. 5 is a squeegee device according to the invention with a link pivot bearing and FIGS. 6 to 8 show another squeegee device according to the invention.

Figure 1:
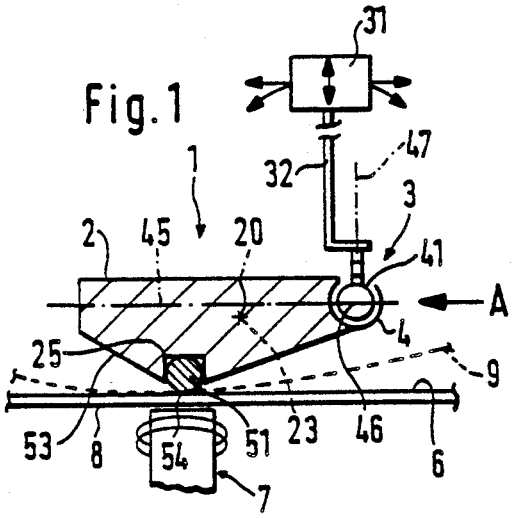

The squeegee device 1 shown in the drawings is part of a not shown applicator (applying device). Each squeegee device 1 comprises an optionally magnetizable profile member (body) 2, which is provided together with a working or doctor edge 54 of a squeegee 5 for acting on an application surface (substrate) 6. In the case of magnetic pressing of the working/doctor edge 54 and the relative movement thereof along the application surface 6, an application substance is applied to the application surface 6, optionally through a patterning stencil, such as a flat or round stencil 9. The substrate 6 is guided or held on a (counter)abutment surface 8. On the latter is arranged an electromagnet beam 7 extending over the application width to magnetically engage the profile member 2, which is made from magnetizable material, including the optionally magnetizable squeegee 5 for pressing purposes.

Figure 2:
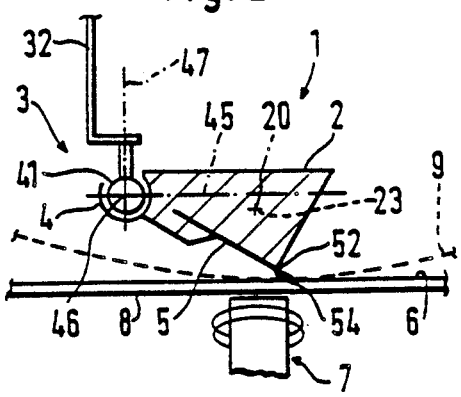
Figure 3:
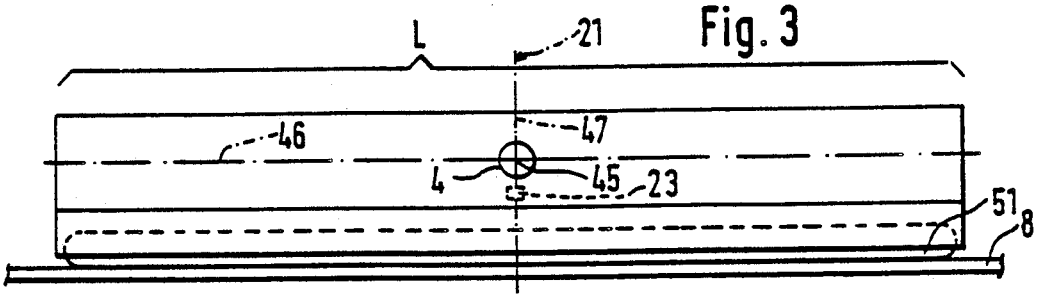
FIG. 3 shows a longitudinal view of the squeegee device according to the invention of FIG. 1 from direction A.

According to FIGS. 1 and 2 a pivot bearing means 3 of squeegee device 1 according to the invention is constructed in the form of a ball or spherical joint 41, which, as shown in FIG. 3, is arranged in the centre of the length L (application width) of a magnetizable profile member 2 in lateral manner thereon with a ball joint shell or cup. Thus, the multiple pivot point of the spherical joint 41 is located in a plane 21, which perpendicularly intersects the longitudinal axis 20 of the profile member in its position parallel to the application surface and in which is located the pivot point of the profile member 2. The profile member 2 is freely pivotably mounted about all directions in space with the spherical joint 41.

In particular, the profile member 2 is freely tiltable or pivotable about an axis 45 being perpendicular to the longitudinal axis of the profile member 2, said axis 45 having the positions of a sheaf of axes perpendicular to the member longitudinal axis 20, in that they in turn are freely pivotable or rotatable about a spherical joint axis 46 parallel to axis 20. In particular, by means of the spherical joint 41, a free pivotability of the profile member 2 about a spherical joint axis 47 being perpendicular to the axis 45 is also obtained and which is therefore in turn freely pivotable or rotatable about the spherical joint axis 46 and the axis 45. Thus, the profile member 2 and squeegee 5 arranged thereon are mounted in self-adjusting manner in the case of a magnetic pressing of the profile member 2 in the direction of the application surface 6 (the abutment 8) by means of a magnetization of the magnetic beam 7 located beneath the abutment 8. Each squeegee 5 engages the application surface 6 in a manner free from tilting and distortion and without any impediment by the profile member mounting.

As can be seen in FIGS. 1 and 2, the spherical joint 41 is carried by a holding member 32 of an applying device. This enables the spherical joint 41 to move in directions perpendicular towards and along the counterabutment 8. Within the applying device, a guide bearing 31 (FIG. 1) is provided with which the holding part 32 is pivotable or movable in at least some of the directions entered in FIG. 1. It can be seen that through a spacing variation of the spherical joint 41 with respect to the abutment 8 by means of the guide bearing 31, it is possible to achieve in a simple manner a controlled pivoting of the profiled body about the spherical joint axis 46.

In FIG. 1 the profile member 2 is constructed as a support body being optionally magnetizable and pressing a squeegee 5 against the application surface 6 and having a recess 25 positioned parallel to its longitudinal axis 20, in which is mounted the squeegee 5 in the form of a magnetizable roller doctor 51. The latter is freely rotatable in the recess 25.

On the profile member 2 is formed a profiled surface 53 adjacent to the recess 25 and which extends along the member longitudinal axis 20 and parallel thereto. It brings about a dosing of the application substance located upstream of the roller doctor 41. It also permits a planned prior squeegee treatment. The dosing or prior squeegee treatment can be checked and controlled in a simple manner by varying the inclination position of the profiled surface 53 due to a spacing change of the spherical joint 41 relative to the abutment 8

In FIG. 2 a sheet spreading doctor or blade 52 is arranged on the magnetizable profile member 2. The inclination of said blade with respect to the abutment 8 is variable in the same way as the inclination of the profiled surface 53 in the embodiment according to FIG. 2 by modifying the spacing of the spherical joint 41.

Figure 4:
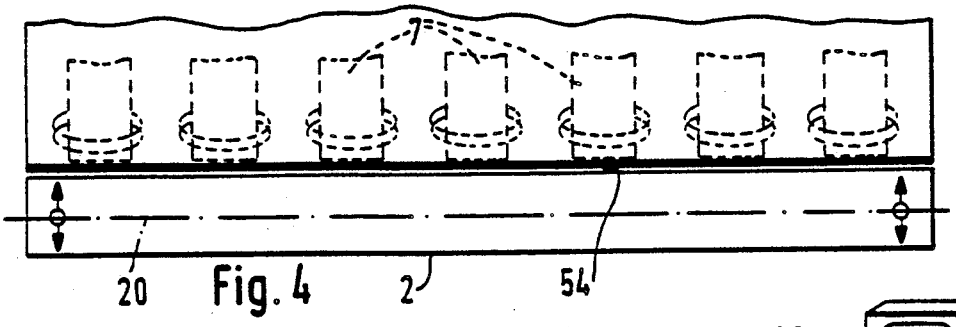
FIG. 4 is a plan view of a squeegee device according to the invention with a doctor (squeegee) profile member extending along a roller.
Figure 5:
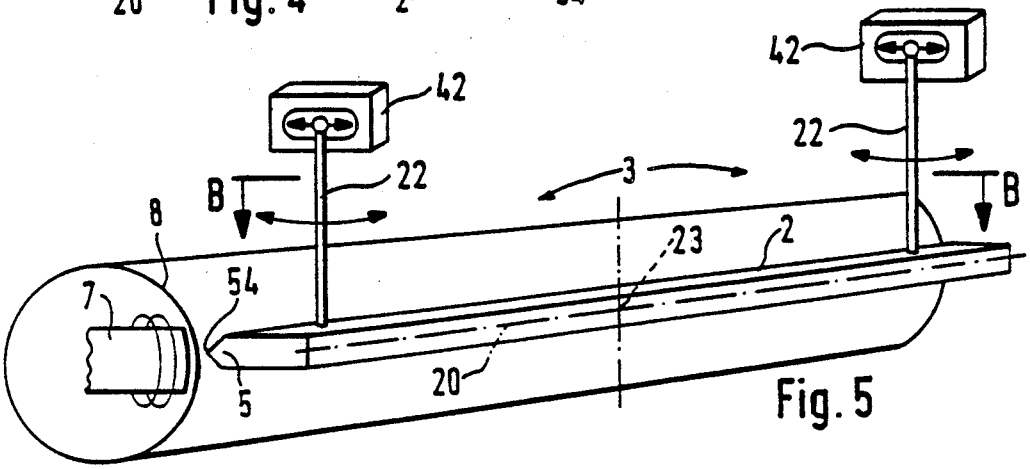

FIGS. 4 and 5 show a further embodiment of a pivot bearing 3 for a profile member 2. As shown in FIG. 5, the profile member 2 is connected respectively to an arm 22 in the vicinity of each of its longitudinal side ends. Each arm is held with its free end in a link bearing in such a way that it is movable in directions transverse to and along the longitudinal axis 20 of the profile member. This leads to an oscillating, swing-like suspension for the profile member 2, which is freely pivotable at least about an axis parallel to its longitudinal axis 20 and also about an axis 47 perpendicular thereto, the axis 47 being in turn freely pivotable about the longitudinal axis 20.

On the profile member 2 is formed in its longitudinal direction a doctor 5 with a wedge-shaped working edge 54, which works against a roller forming an abutment 8. Within the roller 8 is provided a magnetic beam or bar 7 for magnetic pressing of the magnetizable profile member 2 in the direction of the roller abutment 8. FIG. 4 is a plan view according to B—B in FIG. 5 representing the transverse mobility of the profile member 2 with respect to the roller 8. It can be seen that the profile member 2 engages in tilting-free and self-adjusting manner on the roller 8 on a substrate web moved vertically past the working edge 54.

FIGS. 6 to 8 show a further squeegee device 1 according to the invention in side view, longitudinal view (section A—B) and plan view. A pivot bearing 3 arranged on the profile member 2 is constructed as a carriage or drawer-like bearing. A roller or wheel pair 43 is arranged on each of the end faces of the profile member 2. The rollers run on bearing surfaces or paths 44, which form part of a bearing 40 and extend transversally to an application surface 6. In this way the profile member 2 is movable or positionally variable with a doctor edge 54 in the transverse and longitudinal direction with respect to the application surface 6. The movement directions are entered in FIGS. 6 and 8. The bearing means 40 is pivotable about an axis 46 parallel to the longitudinal direction of the squeegee device 1. This pivotability can be gathered from FIG. 6, whilst it is not shown in detail in FIGS. 7 and 8. This leads to a free adjustability of the inclination position of profile member 2 relative to application surface 6. The profile member 2 made from magnetizable material works with its spreading doctor edge 54 against a magnetic beam 7 magnetically engaging with the same and which is arranged within a roller 8, which forms an abutment or guide body for the application surface 6 and extends in the longitudinal direction of device 1 over the application width.

I claim:

1. A squeegee apparatus for applying materials having varying viscosities to an application surface comprising at least one squeegee extending in a longitudinal direction of the apparatus, said squeegee being pressed onto the application surface by a magnetic force and having a profile member with a longitudinal axis extending in the direction of the longitudinal axis of the squeegee, and bearing means for articulating the profile member, at least one of said squeegee and said profile member being formed of magnetic material, and said bearing means being a pivot bearing means for pivotally supporting the profile member with respect to the squeegee apparatus such that the profile member is freely tiltable with respect to a position wherein the profile member is parallel to the application surface about at least one pivot axis that is perpendicular to the longitudinal axis of the profile member.

2. A squeegee apparatus according to claim 1, wherein the pivot bearing means comprises a pivot bearing providing multiple degrees of freedom of movement so that the profile member is freely pivotable about said perpendicular pivot axis and at least one axis parallel to the longitudinal axis of the profile member.

3. A squeegee apparatus according to claim 1, wherein the pivot bearing means comprises a pivot bearing providing multiple degrees of freedom of movement of the profile member with respect to the squeegee apparatus so that the profile member is freely pivotable in all directions.

4. A squeegee apparatus according to claim 1, wherein said pivot bearing means comprises a ball joint.

5. A squeegee apparatus according to claim 1, further comprising:

said profile member having opposite side ends with respect to its longitudinal axis; and said pivot bearing means comprising arms having opposite ends that are fixed at one of their said ends to the profile member in the vicinity of the longitudinal side ends of the profile member and are movably supported in lateral link bearings at the other of their said opposite ends, respectively, in directions transverse to the longitudinal axis of the profile member.

6. A squeegee apparatus according to claim 5, wherein the other of said ends of said arms are movably supported in the link bearings about an axis parallel to the longitudinal axis of the profile member.

7. A squeegee apparatus according to claim 1, further comprising said profile member having a guide bearing path extending transversely with respect to the application surface, sand said pivot bearing means comprising roll bearings so that said profile member is positionable transversely and laterally with respect to the guide bearing path in positions parallel to the guide bearing path.

8. A squeegee apparatus according to claim 1, further comprising guide bearing means for movably supporting said pivot bearing means on said squeegee apparatus so that said pivot bearing means is movable in at least one direction perpendicular to the longitudinal axis of the profile member.

9. A squeegee apparatus according to claim 1, wherein said profile member has a center of gravity, and said pivot bearing means includes a pivot point that is in the vicinity of a plane that vertically intersects the longitudinal axis of the profile member when the profile member is parallel to the application surface, and which contains the center of gravity of the profile member.

10. A squeegee apparatus according to claim 1, wherein the profile member has a recess extending parallel to its longitudinal axis for rotatably supporting the squeegee that is pressed against the application surface.

11. A squeegee apparatus according to claim 4, wherein the profile member has a recess extending parallel to its longitudinal axis for rotatably supporting the squeegee that is pressed against the application surface.

12. A squeegee apparatus according to claim 1, wherein said squeegee includes a blade that contacts the application surface.

13. A squeegee apparatus according to claim 1, wherein said profile member has a permanent magnet or an electromagnet.

14. A squeegee apparatus according to claim 4, wherein said profile member has a permanent magnet or an electromagnet.

15. A squeegee apparatus according to claim 5, wherein said profile member has a permanent magnet or an electromagnet.

16. A squeegee apparatus according to claim 9, wherein said profile member has a permanent magnet or an electromagnet.

17. A squeegee apparatus according to claim 1, wherein said profile member has a row of electromagnets or permanent magnets extending along its longitudinal axis.

18. A squeegee apparatus according to claim 4, wherein said profile member has a row of electromagnets or permanent magnets extending along its longitudinal axis.

19. A squeegee apparatus according to claim 5, wherein said profile member has a row of electromagnets or permanent magnets extending along its longitudinal axis.

20. A squeegee apparatus according to claim 9, wherein said profile member has a row of electromagnets or permanent magnets extending along its longitudinal axis.

21. A squeegee apparatus according to claim 11, wherein said profile member has a row of electromagnets or permanent magnets extending along its longitudinal axis.

* * * * *

UNITED STATES PATENT AND TRADEMARK OFFICE

CERTIFICATE OF CORRECTION

PATENT NO. : 4,993,352

DATED : February 19, 1991

INVENTOR(S) : Johannes Zimmer

It is certified that error appears in the above-identified patent and that said Letters Patent is hereby corrected as shown below:

On the Title page, Item [30] Foreign Application Priority Data,

"Line 3, delete "[EP] European Pat. Off." and insert --[DE] Fed. Rep. of Germany--.

Line 4, delete "[EP] European Pat. Off." and insert --[DE] Fed. Rep. of Germany--.

Line 5, delete "[EP] European Pat. Off." and insert --[DE] Fed. Rep. of Germany--."

Signed and Sealed this

Fifteenth Day of December, 1992

*Attest:*

DOUGLAS B. COMER

*Attesting Officer*

*Acting Commissioner of Patents and Trademarks*